US010724334B2

(12) United States Patent
Poluchalla et al.

(10) Patent No.: US 10,724,334 B2
(45) Date of Patent: Jul. 28, 2020

(54) HYDRAULIC METERING SYSTEM FOR DOWNHOLE HYDRAULIC ACTUATION

(71) Applicant: SCHLUMBERGER TECHNOLOGY CORPORATION, Sugar Land, TX (US)

(72) Inventors: Srinivas Poluchalla, Katy, TX (US); Virinchi Mallela, Novi, MI (US); Francesco Vaghi, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/468,560

(22) Filed: Mar. 24, 2017

(65) Prior Publication Data

US 2018/0274328 A1 Sep. 27, 2018

(51) Int. Cl.

| | |
|---|---|
| ***E21B 34/10*** | (2006.01) |
| ***F15B 11/13*** | (2006.01) |
| ***E21B 23/04*** | (2006.01) |

(52) U.S. Cl.

CPC ..... *E21B 34/10* (2013.01); *E21B 23/04* (2013.01); *F15B 11/13* (2013.01); *F15B 2211/3058* (2013.01); *F15B 2211/405* (2013.01); *F15B 2211/41527* (2013.01); *F15B 2211/7054* (2013.01); *F15B 2211/8752* (2013.01)

(58) Field of Classification Search

CPC ..... E21B 34/10
USPC ..... 166/374
See application file for complete search history.

(56) References Cited

U.S. PATENT DOCUMENTS

| | | | | |
|---|---|---|---|---|
| 7,926,569 | B1 * | 4/2011 | Wintill | E21B 34/10 166/319 |
| 2009/0283276 | A1 * | 11/2009 | Mandrou | E21B 23/04 166/375 |
| 2010/0212521 | A1 * | 8/2010 | Resch | B30B 15/16 100/269.14 |
| 2016/0312579 | A1 * | 10/2016 | Green | E21B 34/10 |
| 2016/0319635 | A1 * | 11/2016 | Du | E21B 43/12 |

* cited by examiner

*Primary Examiner* — Taras P Bemko

(57) ABSTRACT

A technique provides enhanced control over a variety of hydraulically actuated devices, e.g. flow control valves. A hydraulic control module is placed in hydraulic communication with an actuator of a hydraulically actuated device. The hydraulic control module comprises features which prevent hydraulic locking of the system. Additionally, the control module may comprise metering features to enable metered flow of actuating fluid. The features may include valves, mini-indexers, flowline configurations, or other features which maintain the ability to shift the hydraulically actuated device and/or provide metering of the actuating fluid.

19 Claims, 10 Drawing Sheets

HYDRAULIC METERING SYSTEM FOR DOWNHOLE HYDRAULIC ACTUATION

BACKGROUND

Many downhole well systems use downhole flow control valves and other devices which are hydraulically actuated by double acting hydraulic pistons. For example, a downhole control valve may employ a double acting hydraulic piston to operate a moving sleeve which, in turn, controls the inflow or outflow of fluid with respect to the surrounding borehole and formation. Actuating fluid is supplied from a surface pressure source and routed downhole through two hydraulic control lines coupled with hydraulic control chambers on opposed sides of the actuating piston. One hydraulic line provides high-pressure fluid to a hydraulic control chamber on one side of the piston while the other hydraulic line evacuates an equivalent volume of low-pressure exhaust fluid from the hydraulic control chamber on the other side of the piston. However, if the flow of hydraulic actuating fluid into or out of either chamber is blocked, the system becomes hydraulically locked, e.g. the control valve cannot be actuated to a different flow position.

SUMMARY

In general, a system and methodology provide improved control over a variety of hydraulically actuated devices, such as flow control valves. A hydraulic control module is placed in hydraulic communication with an actuator of a hydraulically actuated device. The hydraulic control module comprises features which prevent hydraulic locking of the system. Additionally, the control module may comprise metering features to enable metered flow of actuating fluid. The features may include valves, mini-indexers, flowline configurations, or other features which maintain the ability to shift the hydraulically actuated device and/or provide metering of the actuating fluid. For example, the control module may provide feature configurations which enable mechanical intervention and/or hydraulic override capability.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which provide improved control over a variety of hydraulically actuated devices, e.g. flow control valves. The technique utilizes a control module coupled with the hydraulically actuated device. By way of example, the control module may have various features for metering hydraulic fluid, providing hydraulic override, and/or enabling mechanical intervention without incurring hydraulic lock. In some embodiments, the hydraulic fluid is metered via a mini-indexer combined with cooperating valving. The metering system of the control module enables control without the use of a conventional J-slot indexer in a flow control valve, thus simplifying the control structure by avoiding the complex indexer and pin structure used with a hydraulic housing in a conventional J-slot indexer.

According to an embodiment, a hydraulic control module is placed in hydraulic communication with an actuator of a hydraulically actuated device. The hydraulic control module is coupled with at least one hydraulic control line, e.g. a pair of hydraulic control lines, and comprises features which prevent hydraulic locking of the system. The features may include cooperating valves, mini-indexers, flowline configurations, and/or other features which maintain the ability to meter flow and to shift the hydraulically actuated device. For example, the control module may provide feature configurations which enable mechanical intervention and/or hydraulic override capability.

Figure 1:
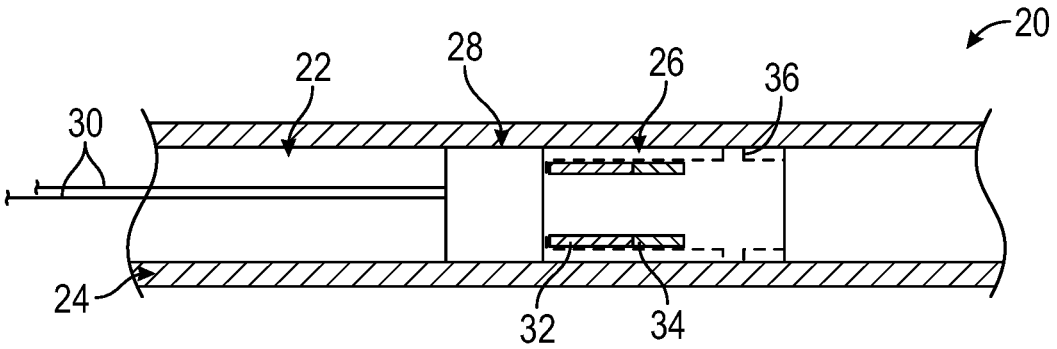
FIG. 1 is a schematic illustration of a well system deployed in a wellbore, the well system comprising an embodiment of a hydraulically actuated device and a hydraulic control module, according to an embodiment of the disclosure.

Referring generally to FIG. 1, an embodiment of a well system 20 is illustrated. In this example, well system 20 has a well string 22 deployed in a wellbore 24, e.g. a horizontal or otherwise deviated wellbore. The well string 22 comprises a hydraulically actuated device 26 and a control module 28 used to control the hydraulic actuation of device 26. The control module 28 receives hydraulic actuating fluid via at least one hydraulic control line 30, e.g. a pair of hydraulic control lines 30. The hydraulic control lines 30 are routed to control module 28 from an actuating fluid pressure source, such as a surface located source.

As explained in greater detail below, the control module 28 comprises various features for metering the flow of hydraulic actuating fluid and/or for preventing hydraulic lock. For example, the control module 28 may comprise various features which enable mechanical intervention and/or hydraulic override. Such features ensure the continued ability to mechanically and/or hydraulically shift the hydraulically actuated device 26 to a desired operational position, e.g. a closed position.

In one type of embodiment, the hydraulically actuated device 26 may be in the form of a flow control valve shiftable between positions enabling flow between an exterior and interior of well string 22. In these types of applications, well string 22 may be in the form of a sand screen assembly completion deployed into a horizontal or otherwise deviated section of wellbore 24. Flow control valve 26 may be actuated via control module 28 to allow or block the inflow of well fluids into the interior of the well string/sand screen assembly 22.

Various types of hydraulically actuated device 26 comprise an actuator piston 32, e.g. a double acting hydraulic actuator piston, which is selectively shifted via control module 28. When hydraulically actuated device 26 is a form of a flow control valve, for example, the actuator piston 32 may be coupled with a sleeve 34 shifted between an open flow position and a closed flow position with respect to a flow passage 36, e.g. a port or ports, extending between an exterior and interior of the well string 22. The control module 28 ensures a desired metering of flow to the actuator piston 32 while maintaining the ability for mechanical intervention and/or hydraulic override so as to shift the actuator piston 32 to a desired operational position.

Figure 2:
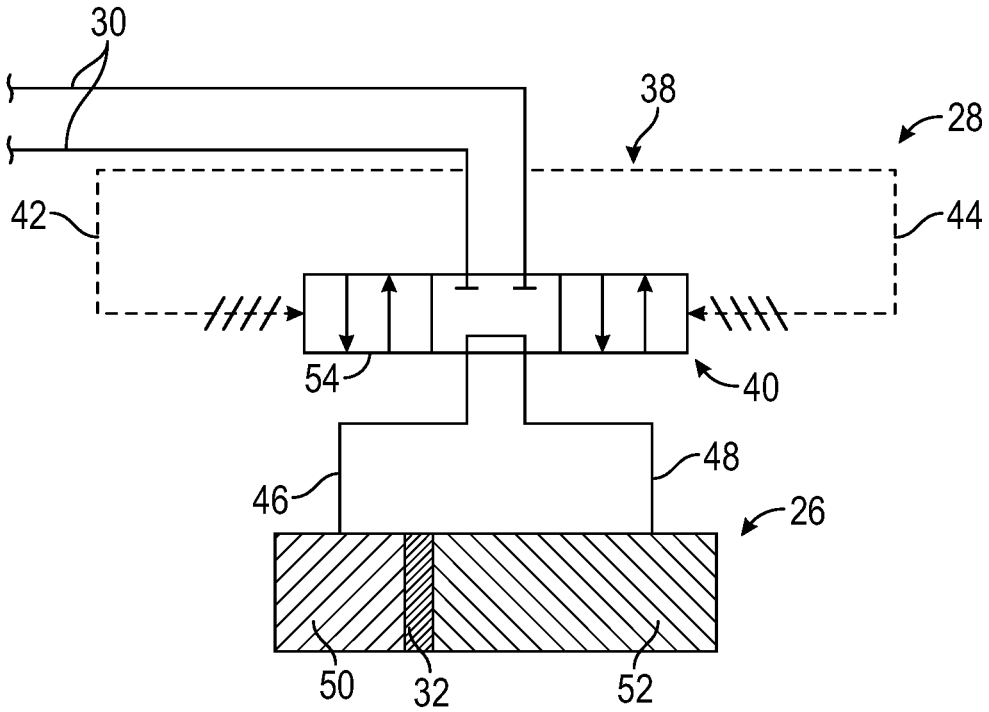
FIG. 2 is a schematic illustration of an example of a control module coupled with a hydraulic actuator of a hydraulically actuated device, according to an embodiment of the disclosure.

Referring generally to FIG. 2, an embodiment of control module 28 is illustrated schematically as operatively coupled with actuator piston 32 of hydraulically actuated device 26, e.g. a flow control valve. In this example, control module 28 comprises a hydraulic circuit 38 having a valve 40, e.g. a spool valve, shiftable between operational positions. Hydraulic actuating fluid is supplied to control module 28 by a pair of the hydraulic control lines 30. The hydraulic circuit 38 comprises an open line 42 coupled between one of the hydraulic control lines 30 and one side of the spool valve 40. Similarly, the hydraulic circuit comprises a close line 44 coupled between the other of the hydraulic control lines 30 and an opposite side of the spool valve 40. The spool valve 40 also is operatively coupled with actuator piston 32 via an actuator open line 46 and an actuator close line 48. For example, the actuator open line 46 may be coupled between spool valve 40 and an open chamber 50 on one side of actuator piston 32 while the actuator close line 48 is coupled between spool valve 40 and a close chamber 52 on the opposing side of actuator piston 32.

Valve 40 has a mechanical override position 54 which allows actuator piston 32 to be mechanically shifted. When in the override position 54, actuator piston 32 is readily shifted by allowing the actuator fluid to simply flow through valve 40 from open chamber 50 to close chamber 52 during manual closure of hydraulically actuated device 26 or vice versa during manual opening of the device 26. In a variety of applications, the valve 40 may normally be biased to the mechanical override position 54. However, pressure applied via either of the hydraulic lines 30 pilots the valve 40 to switch the valve 40 to a different hydraulic flow position.

For example, if piloting pressure is applied via the appropriate hydraulic control line 30 to close line 44, the valve 40 is shifted to a flow position which allows hydraulic actuating fluid to flow through valve 40 and into close chamber 52 via actuator close line 48. Actuating fluid within open chamber 50 is then bled out through actuator open line 46, through valve 40, and out through the other hydraulic control line 30. If, on the other hand, piloting pressure is applied via the appropriate hydraulic control line 30 to open line 42, the valve 40 is shifted to a flow position which allows hydraulic actuating fluid to flow through valve 40 and into open chamber 50 via actuator open line 46. Actuating fluid within close chamber 52 is then bled out through actuator close line 48, through valve 40, and out through the other hydraulic control line 30.

Depending on the application, the piloting pressure used to shift the valve 40 may be at a substantially lower level than the pressure used to shift actuator piston 32 of hydraulically actuated device 26. This enables valve 40 to operate before a substantial differential pressure is established with respect to the valve 40. In other words, valve 40 is able to function with a low equalization pressure across the ports of valve 40 in fluid communication with hydraulic lines 42, 44.

Figure 3:
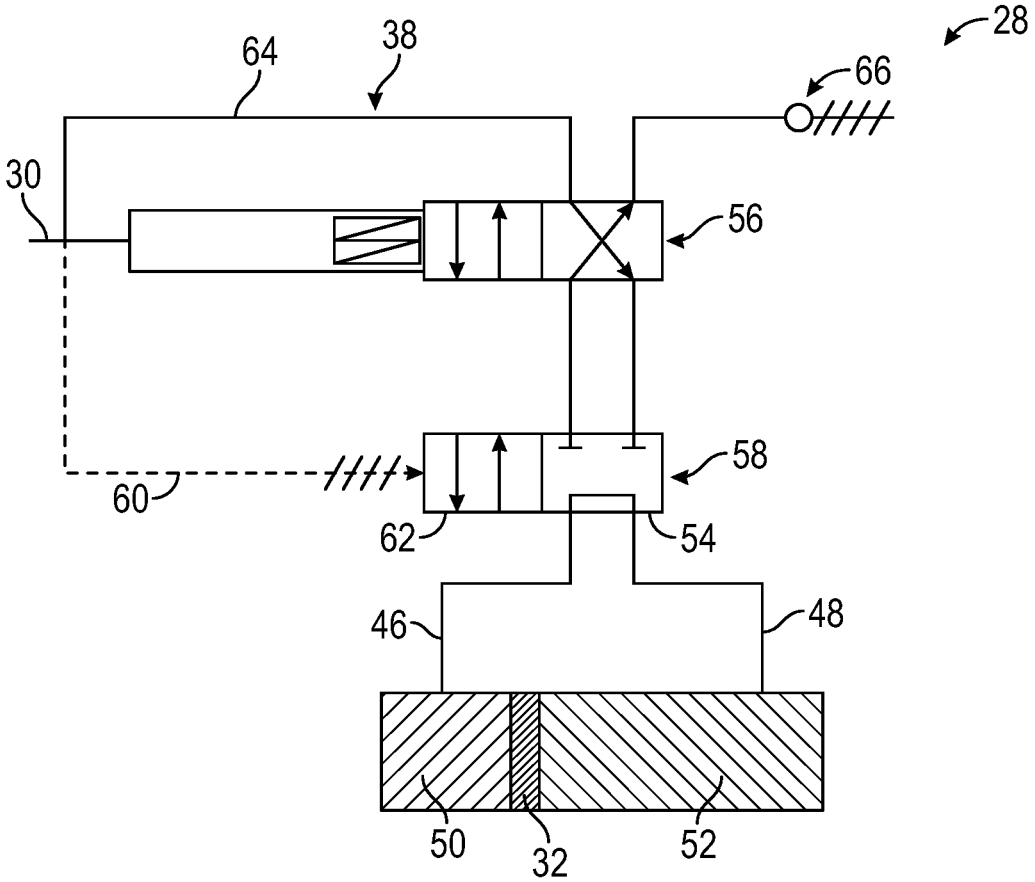
FIG. 3 is a schematic illustration of another example of a control module coupled with a hydraulic actuator of a hydraulically actuated device, according to an embodiment of the disclosure.

Referring generally to FIG. 3, another embodiment of control module 28 is illustrated. In this example, the control module 28 is supplied with actuating fluid via a single hydraulic control line 30. As illustrated, the hydraulic control line 30 is coupled into hydraulic circuit 38 which further comprises a mini indexer 56 having, for example, two indexer positions to control flow into either open chamber 50 or close chamber 52. The hydraulic circuit 38 also comprises a two position valve 58 which comprises the mechanical override position 54 to enable manual shifting of actuator piston 32, as described above.

In this example, the valve 58 may normally be positioned in the mechanical override position 54, as illustrated. When a piloting pressure is applied in hydraulic control line 30, the piloting pressure is directed to valve 58 via hydraulic line 60 of hydraulic circuit 38. The piloting pressure causes valve 58 to shift to a flow position 62 which allows hydraulic actuating fluid to flow along hydraulic line 64, through mini-indexer 56, through valve 58, and into one of open chamber 50 or close chamber 52 to shift actuator piston 32 in the desired direction. By applying an increased indexer pressure on hydraulic control line 30 via a pressure pulse or pulses, the mini-indexer 56 may be cycled to the desired flow position.

In the position illustrated in FIG. 3, actuating fluid flows from hydraulic control line 30, through hydraulic line 64, through mini-indexer 56, and into the close chamber 52 when valve 58 is actuated to the flow position 62. By applying the appropriate pulse or pulses of increased indexer pressure on hydraulic control line 30, the mini-indexer 56 may be cycled to the other flow position which allows actuating fluid to flow into the open chamber 50 so as to shift actuator piston 32 in an opposite direction. When actuating fluid flows into chamber 50 or 52, the actuating fluid on the opposite side of actuator piston 32 flows out through valve 58, mini-indexer 56, and to a vent outlet 65. By way of example, the vent outlet to five may direct the vented actuating fluid to a reservoir or to the wellbore annulus surrounding well string 22.

Figure 4:
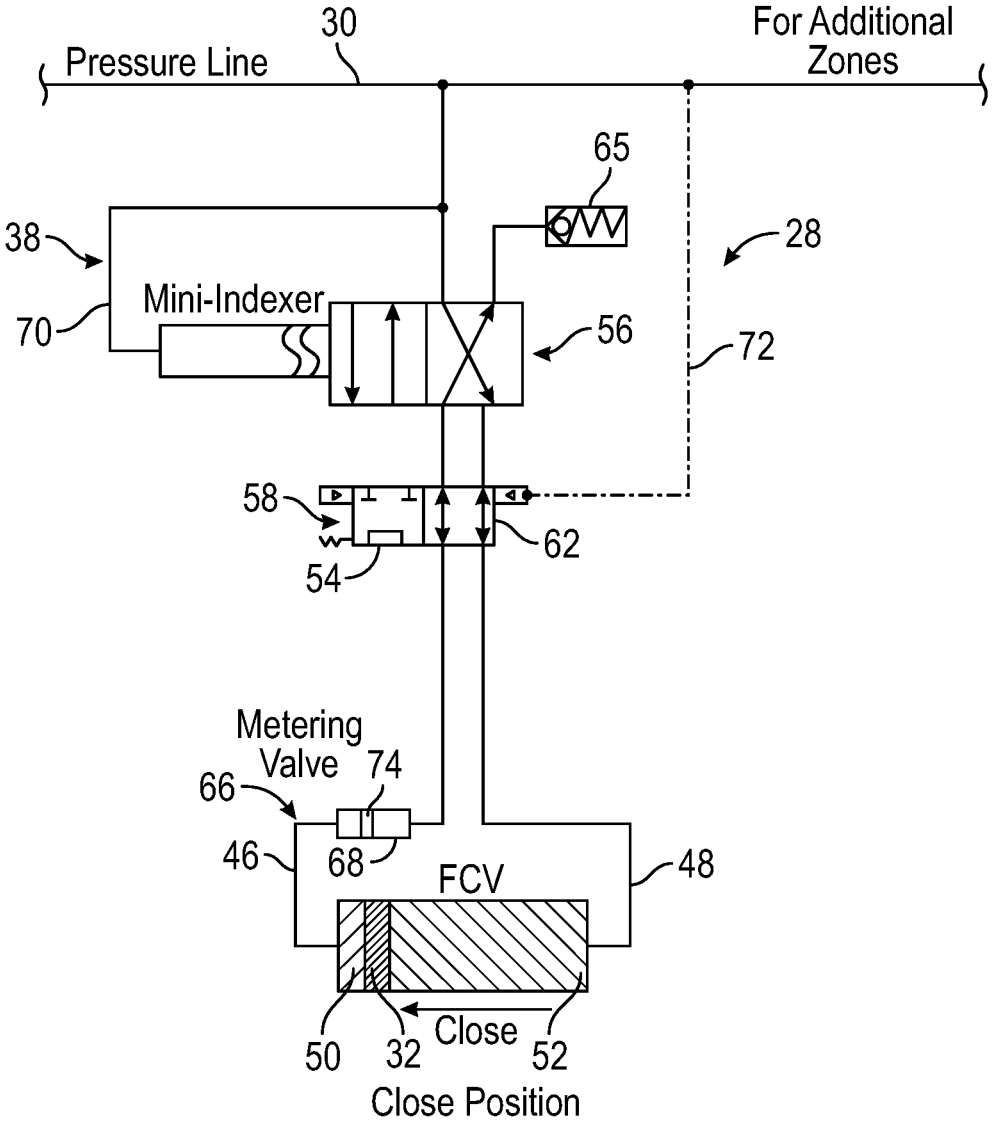
FIG. 4 is a schematic illustration of another example of a control module coupled with a hydraulic actuator of a hydraulically actuated device, according to an embodiment of the disclosure.

Referring generally to FIG. 4, another embodiment of control module 28 is illustrated. In this embodiment, the hydraulic circuit 38 comprises a metering system 66 having a metering valve 68 positioned to enable a controlled metering of fluid to the hydraulic actuator piston 32. In this example, hydraulic control line 30 serves as a pressure supply line to a single zone or a plurality of zones. For example, the hydraulic control line 30 may supply hydraulic actuating fluid to a plurality of control modules 28 coupled with a corresponding plurality of flow control valves 26 located in multiple well zones along well string 22, e.g. along a sand screen assembly completion string.

In this example, the hydraulic circuit 38 comprises a hydraulic pressure line 70 coupled with mini-indexer 56 which has, for example, two indexer flow positions. Pressure pulses at a suitable pressure level may be applied via hydraulic control line 30 and hydraulic pressure line 70 to shift the mini-indexer 56 to the desired flow position. The hydraulic circuit 38 also comprises two position valve 58 which may normally be biased to the mechanical override position 54. However, sufficient pressure in hydraulic control line 30 effectively applies a pressure against valve 58 via hydraulic line 72 so as to shift the valve 58 to flow position 62.

The hydraulic circuit 38 enables hydraulic override so as to quickly move actuator piston 32 back to a default position, e.g. an original position. For example, when mini-indexer 56 is in the flow position illustrated in FIG. 4 and valve 58 is actuated to flow position 62, as further illustrated in FIG. 4, hydraulic actuating fluid may be supplied through hydraulic control line 30 and delivered through mini-indexer 56, through valve 58, and through actuator close line 48 to close chamber 52. As actuating fluid flows into close chamber 52, the actuator piston 32 is shifted in a closing direction. While actuator piston 32 moves in the closing direction, actuating fluid in open chamber 50 is vented through metering valve 68, through valve 58, through many-indexer 56, and is discharged through vent outlet 65. The arrangement of valves and flow passages effectively serves as a hydraulic override system or arrangement that enables hydraulic shifting of actuator piston 32 to a default position without incurring hydraulic lock.

Figure 5:
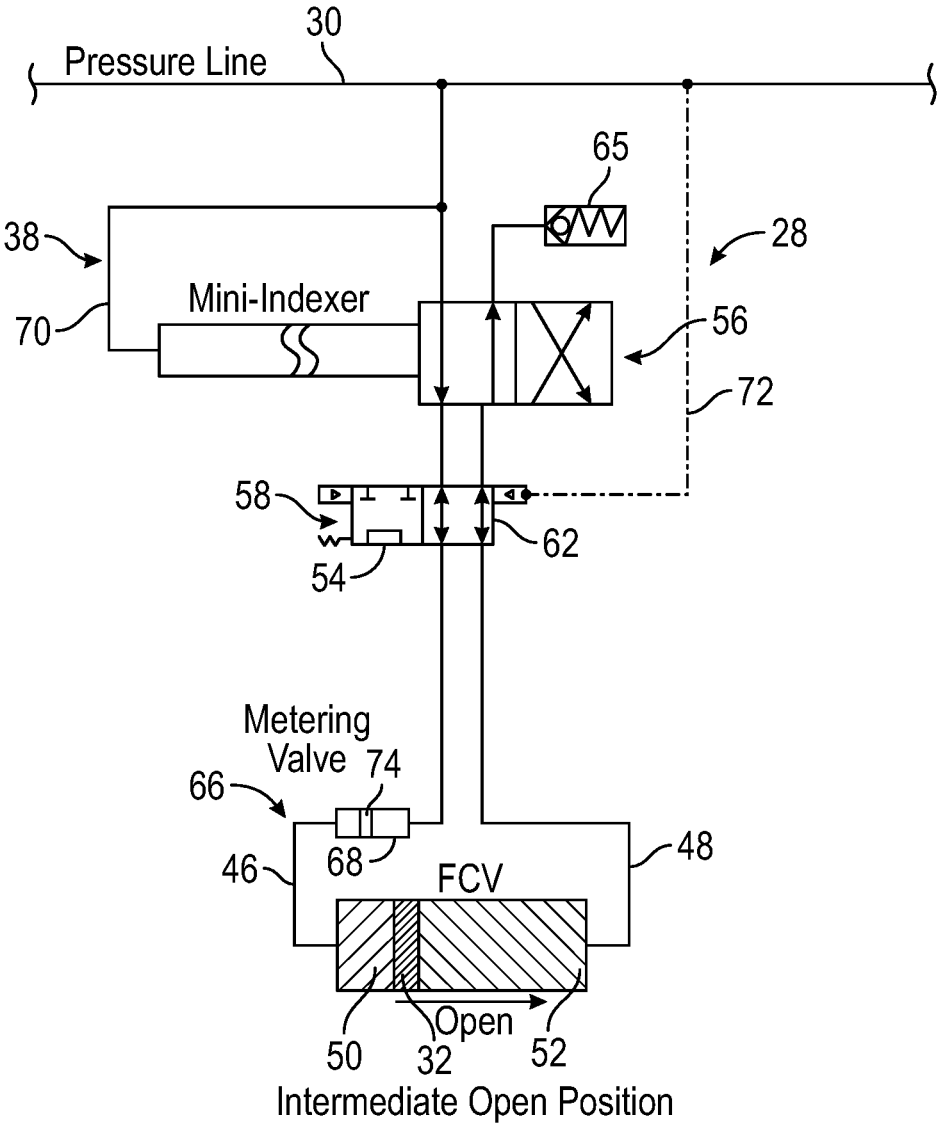
FIG. 5 is a schematic illustration similar to that of FIG. 4 but showing the control module in a different operational configuration, according to an embodiment of the disclosure.

By applying the appropriate pressure pulse or pulses to mini-indexer 56, the mini-indexer 56 may be shifted to the other flow position which enables shifting of actuator piston 32 in an opening direction, as illustrated in FIG. 5. As illustrated, sufficient pressure is applied via hydraulic line 72 to maintain valve 58 in open flow position 62. The pressurized actuating fluid is thus able to travel through the metering valve 68 which may be located along actuator open line 46. The metering valve 68 comprises a spring-loaded metering piston 74 which travels under the pressure of actuating fluid until reaching a hard stop at which point pressure increases within actuator open line 46 and hydraulic circuit 38. The pressure in actuator open line 46 is then relaxed to allow spring-loaded metering piston 74 to move back to an original position before the higher pressure level is again applied in actuator open line 46. The repeated cycling of metering valve 68 enables repeated discharge of a predetermined volume of hydraulic actuating fluid and a corresponding incremental movement of actuator piston 32 in the open direction illustrated in FIG. 5. It should be noted the metering pistons used in various embodiments described herein are spring biased back to an original position, however other techniques may be used to move the metering piston back so as to load the metering valve/assembly with the predetermined volume of actuating fluid.

Depending on the parameters of a given operation, the embodiment of control module 28 illustrated in FIGS. 4-5 may have various configurations. For example, the illustrated embodiment may be continually shifted to a closed position by pumping fluid through actuator close line 48. However, the location or orientation of metering valve 68 may be changed to enable continual shifting to the open position by pumping fluid through actuator open line 46. The hydraulic circuit configuration also enables application of relatively large piston forces which can be used for scale breaking, overcoming seal friction, or other higher force actions. The areas of metering valve piston 74 being acted on (and acting on) the hydraulic actuation fluid also can be adjusted to enable, for example, boosting of the pressure acting on actuator piston 32. In some embodiments, the metering valve 68 and overall metering system 66 may be a modular system to enable easy changing of the metering valve 68 for variations in incremental strokes of the actuator piston 32.

Figure 6:
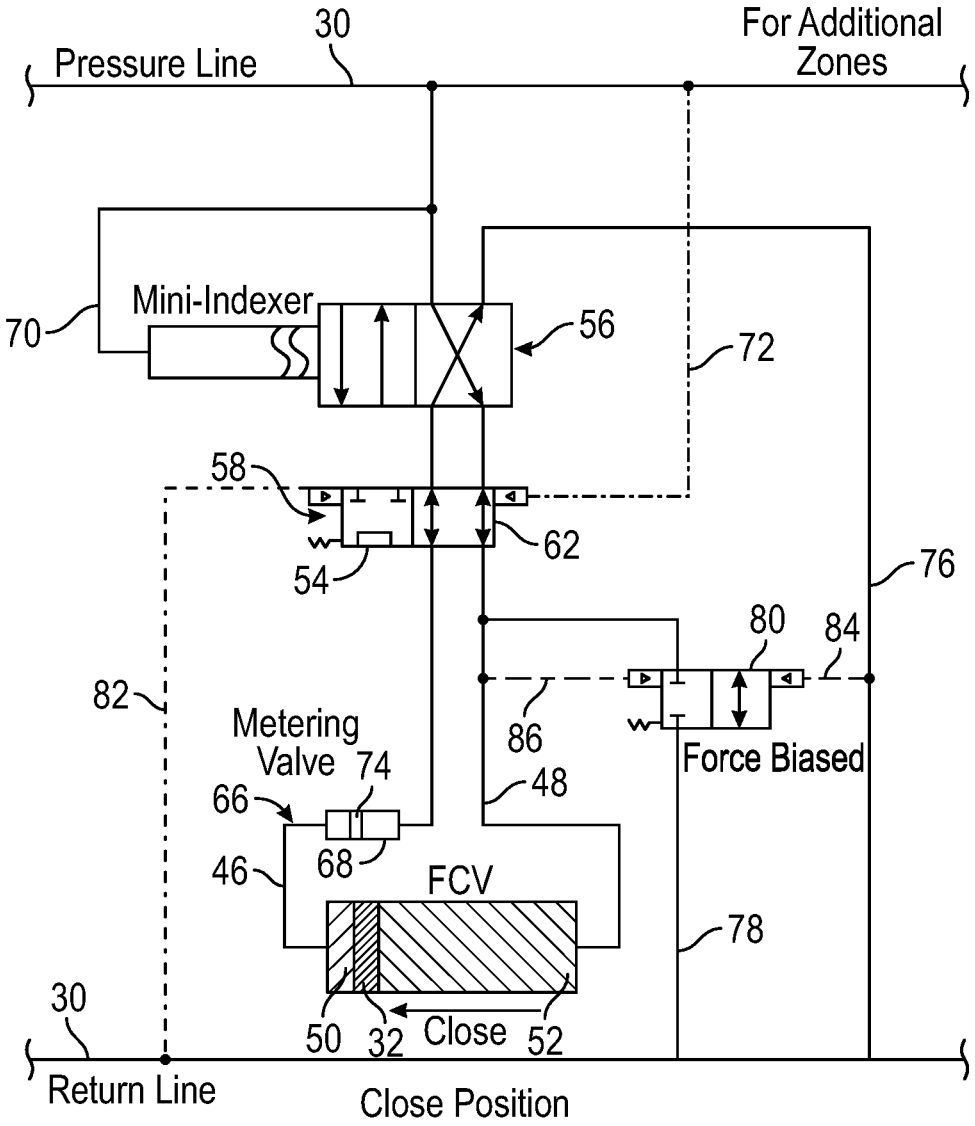
FIG. 6 is a schematic illustration of another example of a control module coupled with a hydraulic actuator of a hydraulically actuated device, according to an embodiment of the disclosure.
Figure 7:
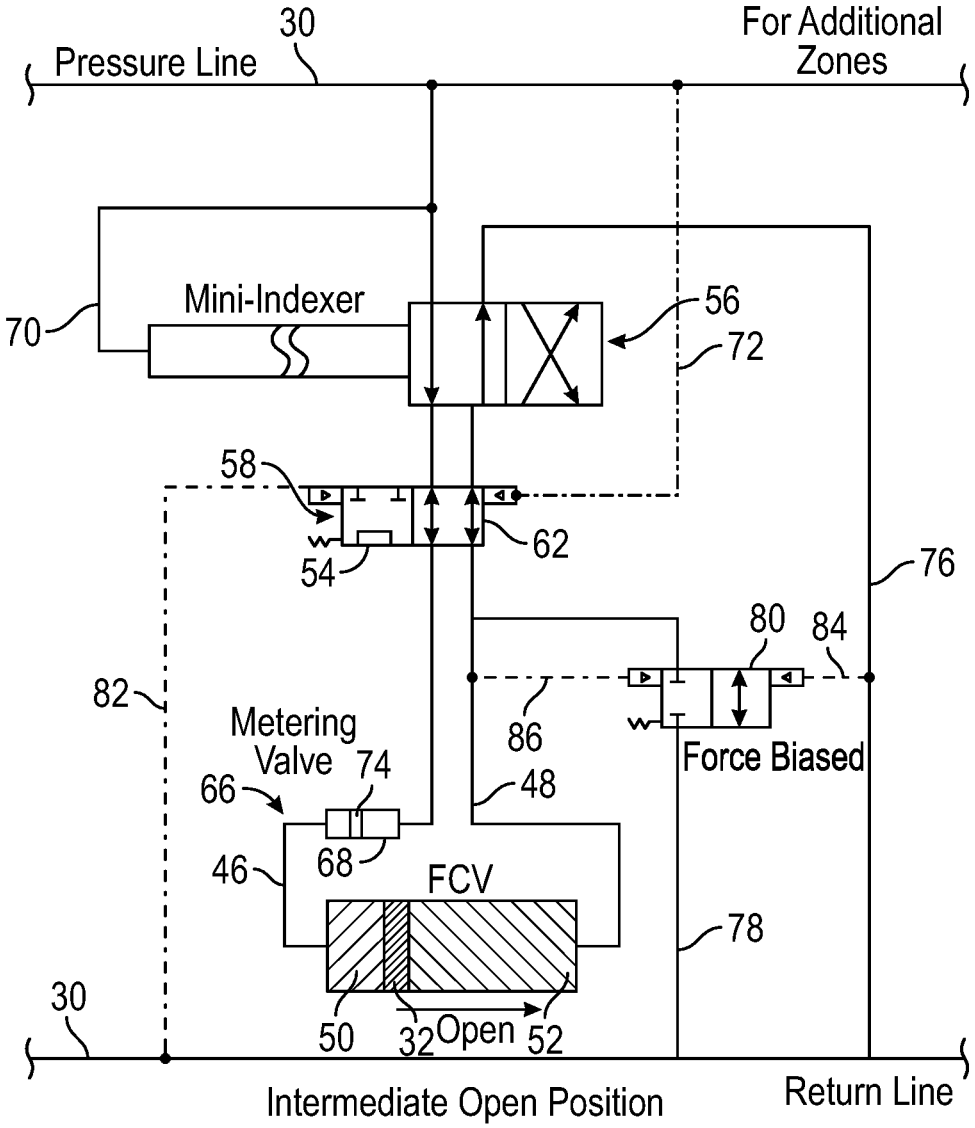
FIG. 7 is a schematic illustration similar to that of FIG. 6 but showing the control module in a different operational configuration, according to an embodiment of the disclosure.
Figure 8:
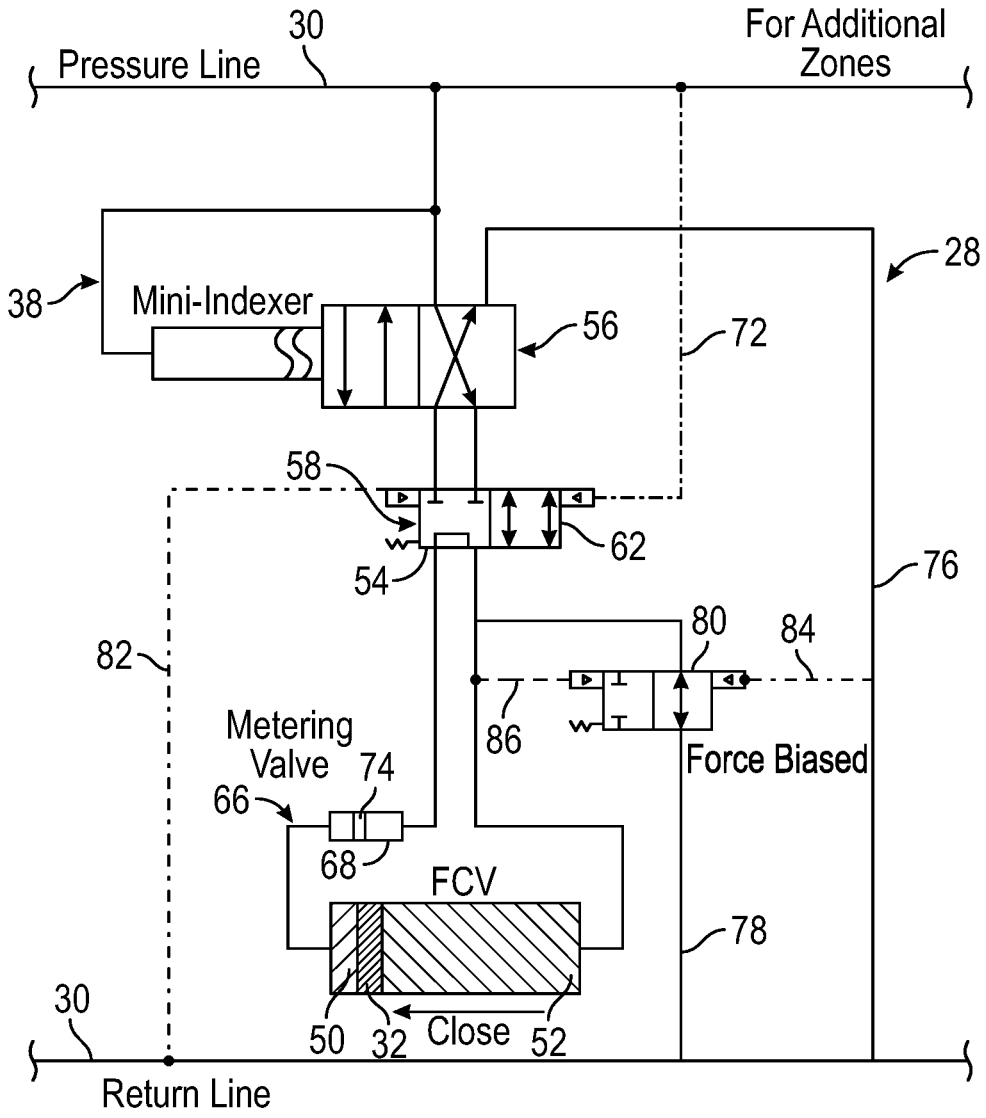
FIG. 8 is a schematic illustration similar to that of FIG. 7 but showing the control module in a different operational configuration, according to an embodiment of the disclosure.

Referring generally to FIGS. 6-8, another embodiment of control module 28 is illustrated. In this example, many of the components are similar to or the same as components described in the embodiment illustrated in FIGS. 4-5 and the same reference numerals have been used to denote common components. In this embodiment, however, two hydraulic control lines 30 are coupled with the control module 28 in the form of a pressure line (see upper illustrated control line 30) and a return line (see lower illustrated control line 30).

The return hydraulic control line 30 is in fluid communication with mini-indexer 56 via hydraulic line 76. Additionally, the return hydraulic control line 30 is in fluid communication with actuator close line 48 via hydraulic line 78. A two position valve 80 is disposed along hydraulic line 78 and may be shifted between a flow position and a no-flow position with respect to fluid in hydraulic line 78. Furthermore, valve 58 is operatively coupled between hydraulic line 72 and an opposed hydraulic line 82 extending between valve 58 and return hydraulic control line 30. Application of pressure in hydraulic line 72 and/or hydraulic line 82 may be used to shift the valve 58 between flow positions. The two position valve 80, on the other hand, is shifted between the no-flow and flow positions via appropriate hydraulic pressure applied in hydraulic line 84 and/or hydraulic line 86. Hydraulic line 84 is coupled between valve 80 and hydraulic line 76, while hydraulic line 86 is coupled between valve 80 and actuator close line 48.

When mini-indexer 56 is in the flow position illustrated in FIG. 6, valve 58 is actuated to flow position 62, and valve 80 is in the no-flow position. The hydraulic actuating fluid is supplied by the upper, pressure hydraulic control line 30 and flows through mini-indexer 56, through valve 58, and through actuator close line 48 to close chamber 52. As actuating fluid flows into close chamber 52, the actuator piston 32 is shifted in a closing direction, as illustrated in FIG. 6. While actuator piston 32 moves in the closing direction, actuating fluid in open chamber 50 is vented through metering valve 68, through valve 58, through many-indexer 56, through hydraulic line 76, and into the return hydraulic control line 30. The arrangement of valves and flow passages again effectively serves as a hydraulic override system or arrangement that enables hydraulic shifting of actuator piston 32 to a default position without incurring hydraulic lock.

By applying the appropriate pressure pulse or pulses to mini-indexer 56, the mini-indexer 56 is shifted to the other flow position which enables shifting of actuator piston 32 and an opening direction, as illustrated in FIG. 7. In the example illustrated, sufficient pressure is applied via hydraulic line 72 to maintain valve 58 in open flow position 62. The pressurized actuating fluid is thus able to travel through the metering valve 68 which may be located along actuator open line 46. As described above, the metering valve 68 may comprise spring-loaded metering piston 74. The spring-loaded metering piston 74 is moved via the pressure of actuating fluid until reaching a hard stop at which point pressure increases within actuator open line 46. The pressure in actuator open line 46 is then relaxed to allow spring-loaded metering piston 74 to move back to an original position before the higher pressure level is again applied in actuator open line 46. The repeated cycling of metering valve 68 enables a corresponding incremental movement of actuator piston 32 in the open direction illustrated in FIG. 7.

However, when a hydraulic override is desired, pressure on the return hydraulic control line 30 may be increased to shift the valve 58 to the override position 54, as illustrated in FIG. 8. In this position, fluid may freely communicate through valve 58 from open chamber 50 to close chamber 52. Consequently, the actuator piston 32 may be moved through mechanical intervention or by supplying actuating fluid under sufficient pressure through return hydraulic control line 30. The pressurized actuating fluid shifts valve 80 to the open flow position so that actuating fluid may flow from return hydraulic control line 30, into hydraulic line 78, through valve 80, and into close chamber 52, thus shifting actuator piston 32 to the closed position.

Figure 9:
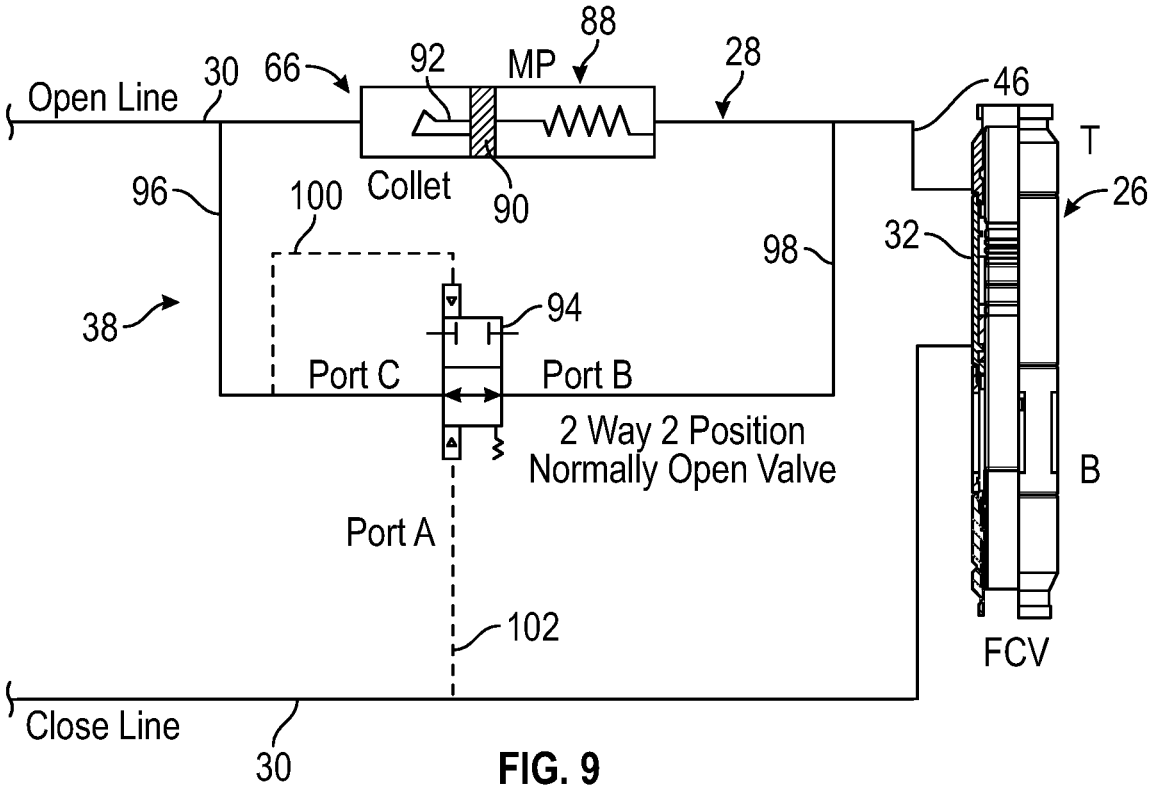
FIG. 9 is a schematic illustration of another example of a control module coupled with a hydraulic actuator of a hydraulically actuated device, according to an embodiment of the disclosure.

Referring generally to FIG. 9, another embodiment of control module 28 is illustrated. In this example, the control module 28 is in operative communication with actuator piston 32 of hydraulically actuated device 26. Hydraulically actuated device 26 may be in the form of a flow control valve. The control module 28 is coupled with two hydraulic control lines 30 in the form of an open line (see upper illustrated hydraulic control line 30) and a close line (see lower illustrated hydraulic control line 30).

The hydraulic circuit 38 of control module 28 comprises metering system 66 having a metering piston assembly 88 with a spring biased metering piston 90 coupled to a collet 92. Additionally, hydraulic circuit 38 comprises a two-way valve 94 which has an open flow position and a no-flow position. In the illustrated example, the two-way valve 94 is biased to the open flow position illustrated in FIG. 9. Additionally, the two-way valve 94 is coupled with open hydraulic control line 30 and actuator line 46 on opposite sides of metering piston assembly 88 via hydraulic lines 96 and 98, respectively. The two-way valve 94 may be actuated between flow and no-flow positions via appropriately pressurized fluid in a hydraulic line 100 coupled between valve 94 and hydraulic line 96 and in a hydraulic line 102 coupled between valve 94 and the close hydraulic control line 30.

When the open hydraulic control line 30 is pressurized to an actuation pressure, the pressure applied through hydraulic lines 96, 100 shifts the two-way valve 94 to the no-flow position. This pressure builds up against a face of the collet 92 until a breaking pressure is reached and the metering piston 90 begins to move in a rightward direction until reaching a hard stop. The movement of metering piston 90 forces a predetermined quantity of actuating fluid through the open actuator line 46 and into the corresponding chamber, e.g. open chamber 50. The hydraulic actuating fluid on the opposite side of actuator piston 32 is vented through the close hydraulic control line 30. In some embodiments described herein, the actuator piston 32 also may be coupled with a collet which breaks and releases after a predetermined pressure, e.g. 2000 psi, acting against actuator piston 32 is reached.

When the pressure applied through open hydraulic control line 30 is reduced to initiate a drain cycle, the valve 94 returns to the open flow position. This allows actuating fluid to flow through hydraulic line 96, valve 94, hydraulic line 98, and into metering piston assembly 88 on the right side of metering piston 90. As the metering piston 90 is returned to its original default position, the metering piston assembly 88 is again filled with the predetermined quantity of actuating fluid. The predetermined quantity of fluid is used to shift actuator piston 32 to the next incremental position upon once again raising the pressure in open hydraulic control line 30 to an actuation pressure able to shift metering piston 90 in a rightward direction until reaching the hard stop. Furthermore, the hydraulic override system comprises close hydraulic control line 30 acting in concert with valve 94. Pressure in the close hydraulic control line 30 shifts valve 94 to a flow position which enables venting of actuating fluid while pressure in the close hydraulic control line 30 moves piston 32 continually to the default position, e.g. closed position, without incurring hydraulic lock.

Figure 10:
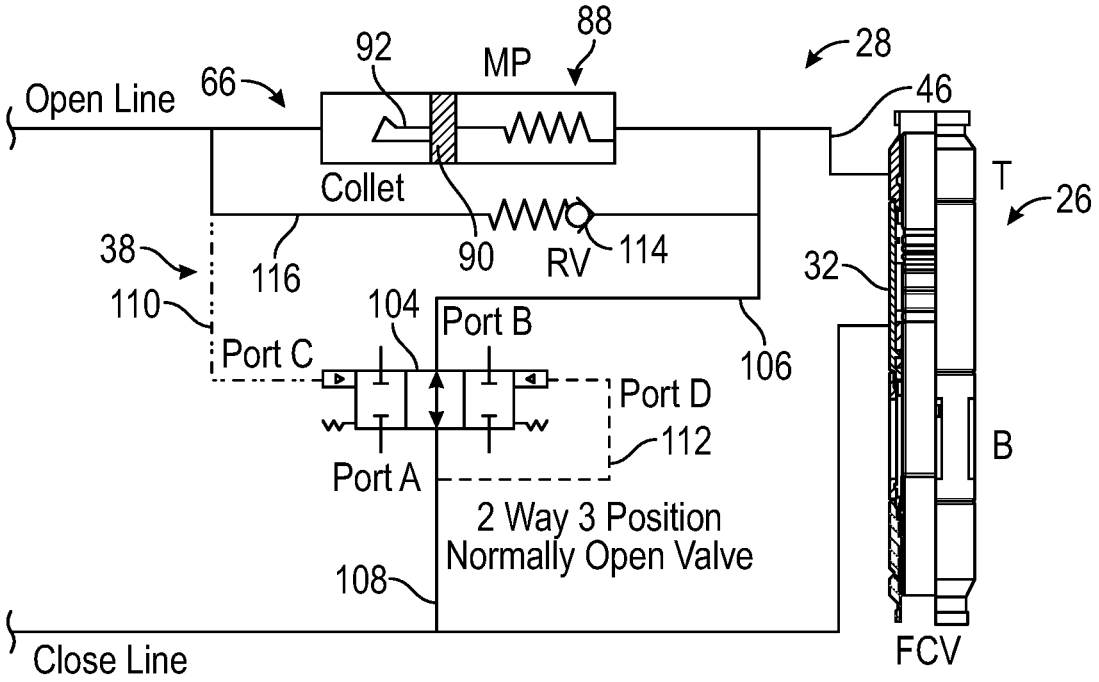
FIG. 10 is a schematic illustration of another example of a control module coupled with a hydraulic actuator of a hydraulically actuated device, according to an embodiment of the disclosure.

Referring generally to FIG. 10, another embodiment of control module 28 is illustrated. In this example, the hydraulic circuit 38 of control module 28 again comprises metering system 66 with metering piston assembly 88 having the spring biased metering piston 90 coupled with collet 92. Additionally, hydraulic circuit 38 comprises a two-way, three position valve 104 which has an open flow position and two no-flow positions. In the illustrated example, the valve 104 is biased to the open flow position.

Furthermore, the valve 104 may be coupled with actuator line 46 via hydraulic line 106 at a position between metering piston assembly 88 and actuator piston 32. The valve 104 also is coupled with close hydraulic control line 30 via hydraulic line 108, as illustrated. The two-way valve 104 may be actuated between a flow position and either of two no-flow positions via appropriately pressurized fluid. The appropriately pressurized fluid may be supplied via a hydraulic line 110 coupled between valve 104 and open hydraulic control line 30 and/or via a hydraulic line 112 coupled between valve 104 and hydraulic line 108, as illustrated.

A relief valve 114 may be coupled across metering piston assembly 88 between open hydraulic control line 30 and hydraulic line 106 via a hydraulic circuit 116. The relief valve 114 provides redundancy in case valve 104 fails to function as intended. If, for example, the two-way, three position valve 104 becomes stuck in a closed position while in a drain cycle, the actuator piston 32 may be shifted via pressure applied in the close hydraulic control line 30 while hydraulic actuating fluid is vented through relief valve 114. If valve 104 is not stuck, the increased pressure in close hydraulic control line 30 shifts the valve 104 to a no-flow position via the increased pressure routed through hydraulic line 112.

When the open hydraulic control line 30 is pressurized to an actuation pressure, the pressure applied through hydraulic lines 110 shifts the valve 104 to one of the no-flow positions. This pressure builds up against a face of the collet 92 until a breaking pressure is reached and the metering piston 90 begins to move in a rightward direction until reaching a hard stop. The movement of metering piston 90 forces a predetermined quantity of actuating fluid into the corresponding chamber, e.g. open chamber 50. The hydraulic actuating fluid on the opposite side of actuator piston 32 is vented through the close hydraulic control line 30.

After the actuator piston 32 is shifted one-stroke, the drain cycle begins. During the drain cycle, the pressure applied through open hydraulic control line 30 is reduced, e.g. reduced to less than 500 psi, and the valve 104 returns to the open flow position. This allows actuating fluid to flow through hydraulic line 106 and into metering piston assembly 88 on the right side of metering piston 90. As the metering piston 90 is returned to its original default position by spring bias or other suitable technique, the metering piston assembly 88 is again filled with the predetermined quantity of actuating fluid. This predetermined quantity of actuating fluid may be used to again shift actuator piston 32 to the next incremental position when pressure in open hydraulic control line 30 is raised to an actuation pressure, thus shifting metering piston 90 in a rightward direction until reaching the hard stop. It should be noted that a hydraulic override arrangement is provided when pressure in the close hydraulic control line 30 shifts valve 104 to a no-flow position and is thus able to move piston 32 continually to the default position, e.g. closed position, without incurring hydraulic lock. During movement of actuator piston 32, actuating fluid is vented through hydraulic circuit 116.

Figure 11:
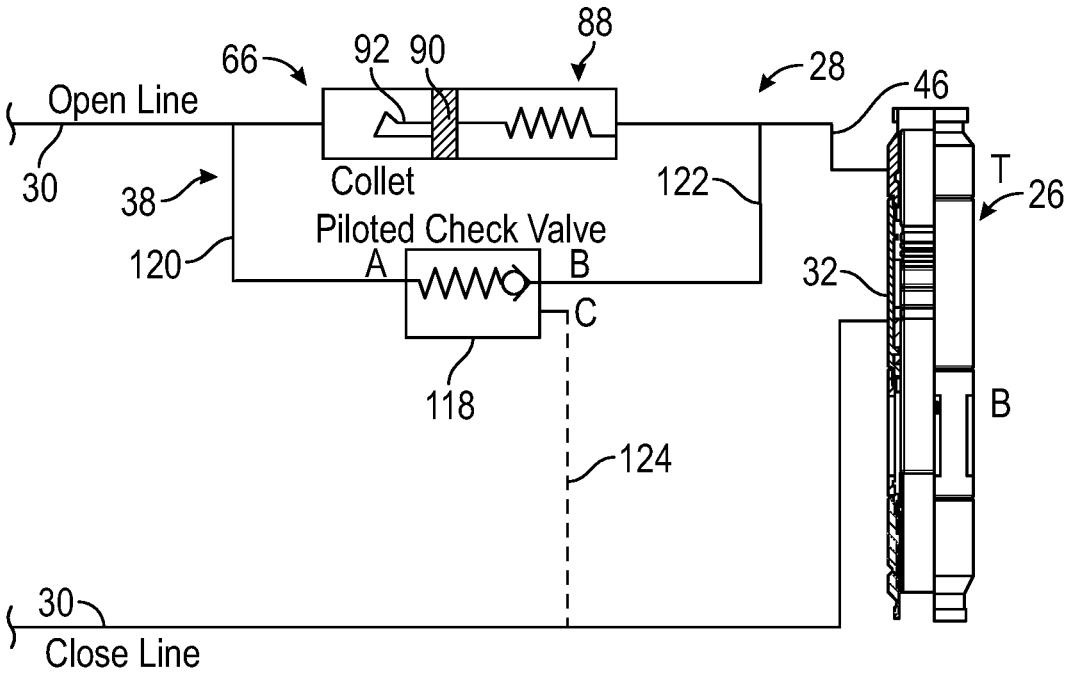
FIG. 11 is a schematic illustration of another example of a control module coupled with a hydraulic actuator of a hydraulically actuated device, according to an embodiment of the disclosure.

Referring generally to FIG. 11, another embodiment of control module 28 is illustrated. In this example, the hydraulic circuit 38 of control module 28 again comprises metering piston assembly 88 having the spring biased metering piston 90 coupled with collet 92. Additionally, hydraulic circuit 38 comprises a piloted check valve 118 which is hydraulically coupled with open hydraulic control line 30 and actuator line 46 on opposite sides of metering piston assembly 88 via hydraulic lines 120, 122, respectively. Additionally, a hydraulic connector line 124 is coupled between piloted check valve 118 and close hydraulic control line 30. In this embodiment, the open hydraulic control line 30 is again illustrated as the upper control line and the close hydraulic control line 30 is again illustrated as the lower control line.

When the open hydraulic control line 30 is pressurized below a predetermined level, e.g. below 10 psi, the piloted check valve 118 is in an open flow position. In this low pressure, open flow condition, actuating fluid is able to fill the rear or rightward side of the metering piston assembly 88. Subsequently, pressure is increased in open hydraulic control line 30 which shifts piloted check valve 118 to a closed position. Upon applying additional pressure, the metering piston 90 is shifted and the predetermined quantity of actuating fluid is delivered to actuating piston 32, e.g. to open chamber 50, to incrementally shift the actuating piston 32 in, for example, the open direction.

When the pressure in open hydraulic control line 30 is reduced to a bleed pressure, the piloted check valve 118 again shifts to an open position. While valve 118 is the open position actuating fluid is drawn into the rightward side of the metering piston assembly 88 as the spring biased metering piston 90 is returned to its original default position. Increasing the pressure in the open hydraulic control line 30 provides a subsequent incremental movement of actuator piston 32. This process may be repeated for the desired number of incremental movements.

However, the actuator piston 32 may be continuously moved to the closed position by applying sufficient pressure in the close hydraulic control line 30. Pressurizing the close hydraulic control line 30 shifts the piloted check valve 118 to an open flow position via pressure applied through hydraulic connector line 124. This establishes a hydraulic override and allows return fluid to freely flow through hydraulic line 122, piloted check valve 118, and hydraulic line 120 as the pressurized hydraulic fluid in close hydraulic control line 30 moves the actuator piston 32 to the fully closed position. As with the embodiments illustrated in FIGS. 4-10, this type of control module 28 enables a metering of actuating fluid to provide an incremental movement, e.g. incremental opening movement, of the actuator piston 32 while also providing a hydraulic override to rapidly shift the actuator piston 32 to a desired position, e.g. a closed position, without incurring hydraulic lock.

Figure 12:
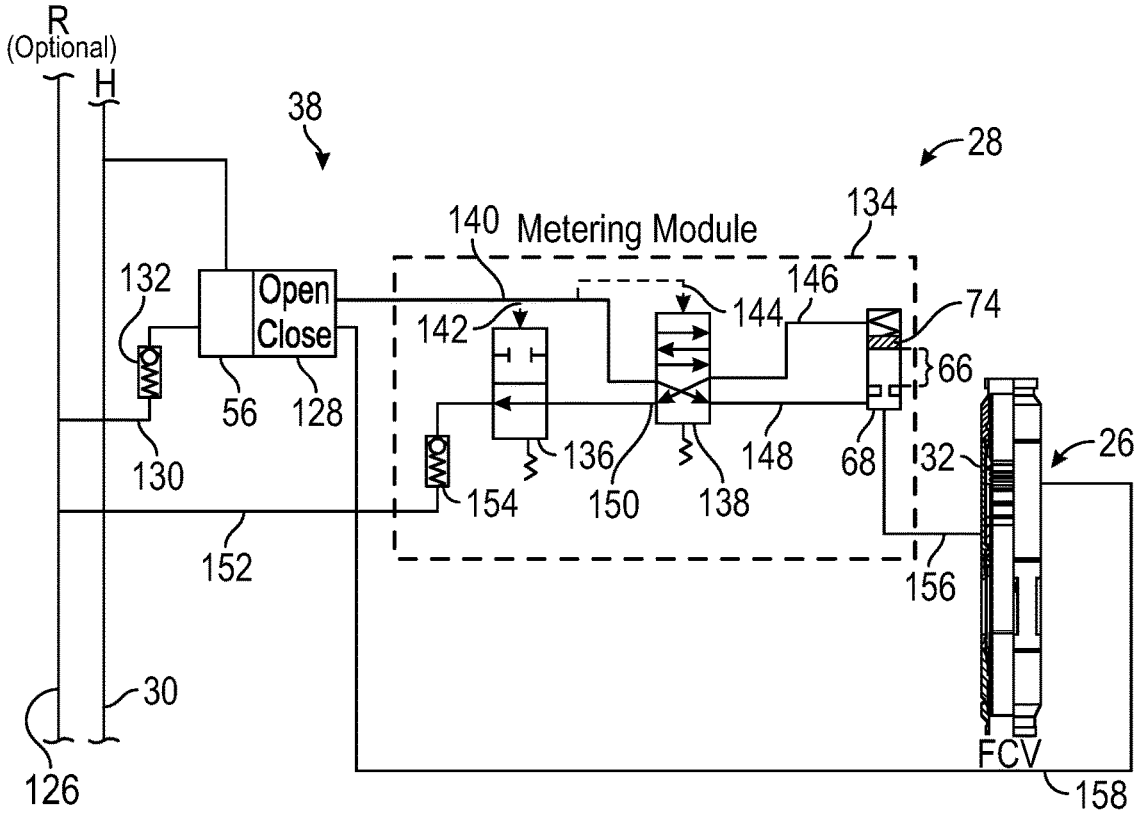
FIG. 12 is a schematic illustration of another example of a control module coupled with a hydraulic actuator of a hydraulically actuated device, according to an embodiment of the disclosure.
Figure 13:
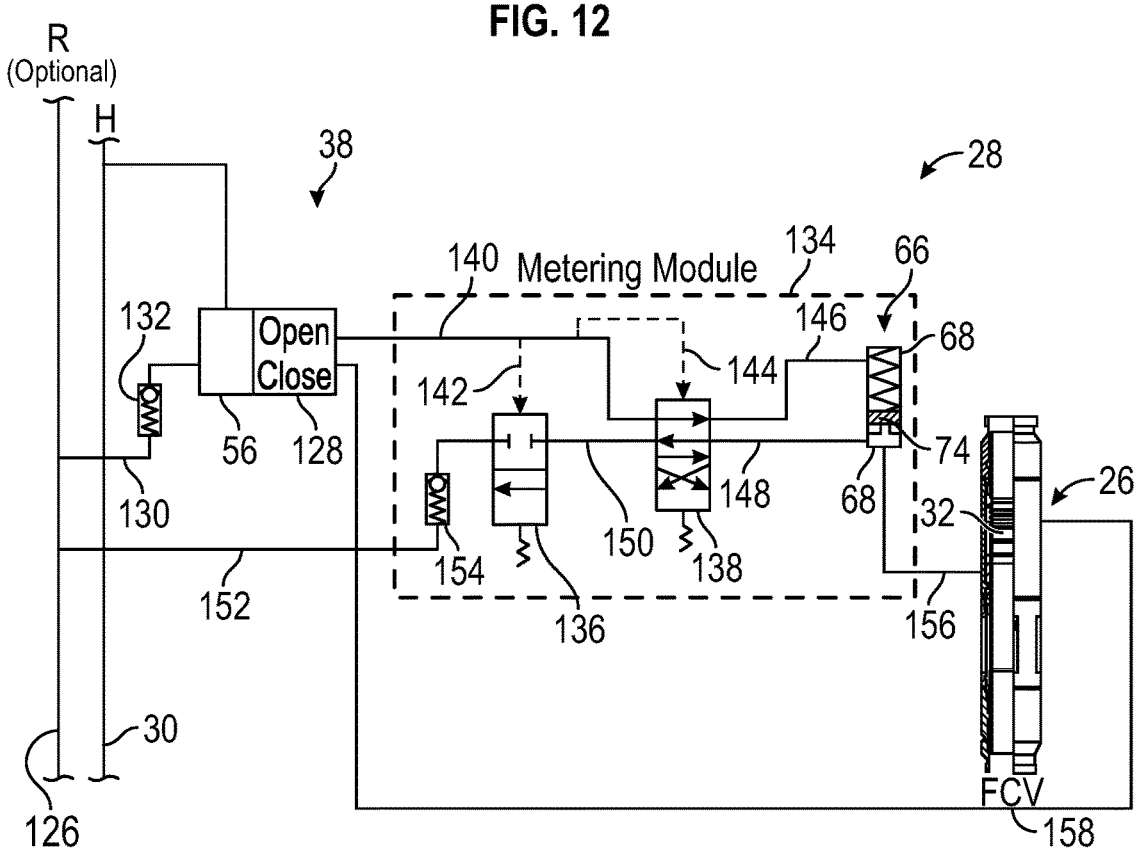
FIG. 13 is a schematic illustration similar to that of FIG. 12 but showing the control module in a different operational configuration, according to an embodiment of the disclosure.

Referring generally to FIGS. 12 and 13, another embodiment of control module 28 is illustrated. In this example, the hydraulic circuit 38 may be operated via hydraulic actuating fluid supplied under pressure via hydraulic control line 30, and hydraulic actuating fluid may be vented to a suitable return 126 (e.g. a return hydraulic control line 30 or a return reservoir). The hydraulic actuating fluid is supplied under pressure to a combined mini-indexer 56 and cooperating valve 128, e.g. a two position, four-way valve. The cooperating valve 28 may be vented to return 126 via a hydraulic line 130 which may include a check valve 132.

In the embodiment illustrated, the cooperating valve 128 also supplies hydraulic actuating fluid to a metering module assembly 134 comprising metering system 66 in the form of metering valve 68 in fluid communication with a first pilot operated valve 136 and a second pilot operated valve 138. In this example, the second pilot operated valve 138 is in communication with valve 128 via a hydraulic line 140. It should be noted the first pilot operated valve 136 and the second pilot operated valve 138 may be shifted via pressure supplied by pilot lines 142, 144, respectively, coupled with the hydraulic pressure line 140. The second pilot operated valve 138 also is fluidly coupled with metering valve 68 via hydraulic line 146 on one side of metering valve piston 74 and via hydraulic line 148 on the other side of metering valve piston 74. Additionally, the second pilot operated valve 138 is in fluid communication with first pilot operated valve 136 via hydraulic line 150. The first pilot operated valve 136 also is in fluid communication with return 126 via a return hydraulic line 152 which may have a check valve 154.

During operation, low-pressure fluid supplied via hydraulic control line 30 flows through mini-indexer 56 and corresponding valve 128 to metering module assembly 134. The low-pressure fluid flows through hydraulic line 140, through second pilot operated valve 138, through hydraulic line 148, and into metering valve 68. The low-pressure fluid moves the metering valve piston 74 to a retracted state as it fills the corresponding piston chamber within metering valve 68 on the side of actuator piston 32, as illustrated in FIG. 12. The volume of this piston chamber is predetermined and may be calibrated to move actuator piston 32 a desired increment within the corresponding flow control valve or other hydraulically actuated device 26. The fluid on the other side of metering valve piston 74 is vented out through hydraulic line 146, second pilot operated valve 138, hydraulic line 150, first pilot operated valve 136, and return hydraulic line 152 for discharge into return 126.

Once metering valve 68 is filled via the inflow of low-pressure hydraulic actuating fluid, the pressure on hydraulic control line 30 is increased. The increased pressure is experienced by pilot lines 142, 144 and causes both first pilot operated valve 136 and second pilot operated valve 138 to shift against spring bias to their shifted positions, as illustrated in FIG. 13. The hydraulic actuating fluid supplied under pressure via hydraulic control line 30 is then able to flow through mini-indexer 56, valve 128, hydraulic line 140, second pilot operated valve 138, and hydraulic line 146 to the top chamber of metering valve 68.

The high-pressure fluid forces metering valve piston 74 to shift until reaching a stop within the metering valve 68. During the forced movement of metering valve piston 74, actuating fluid is directed through a hydraulic line 156 and into a corresponding chamber, e.g. the open chamber 50, adjacent actuator piston 32. The predetermined volume of hydraulic actuating fluid forced into chamber 50 causes actuator piston 32 to move the desired increment.

When pressure on hydraulic control line 30 is reduced to the low-pressure level, the metering module assembly 134 returns to the configuration illustrated in FIG. 12 so that metering valve 68 may be recharged with another predetermined volume of actuating fluid. This process may be repeated to shift actuator piston 32 the desired number of increments in a desired direction, e.g. in an opening direction.

If a hydraulic override is desired to quickly shift actuator piston 32 back to a default position, e.g. a closed position, valve 128 may be appropriately actuated. For example, valve 128 may be actuated to direct hydraulic actuating fluid supplied via control line 30 to flow through a hydraulic close line 158 to an opposite side of actuator piston 32. As the actuator piston 32 is forced to the default/closed position, actuating fluid from the other side of piston 32 is vented through hydraulic line 156, metering valve 68, hydraulic line 148, second pilot operated valve 138, hydraulic line 140, valve 128, and hydraulic return line 130 to return 126. This assembly of components again comprises a hydraulic override arrangement which enables rapid movement of actuator piston 32 to a default position without incurring hydraulic lock.

Various types of mini-indexers 56 and corresponding valves 128 may be used in this type of control arrangement. For example, the mini-indexer 56 may be coupled with a two position, four-way valve 128, and the mini-indexer 56 may be actuated to a desired position according to hydraulic pressure pulses. For example, the mini-indexer may be indexed between two positions, e.g. switched between open and close lines, based on a predetermined number of pressure pulses, e.g. two pulses, four pulses, eight pulses, or another suitable number of pulses.

The mini-indexer 56 also may be constructed to effectively introduce asymmetry into the actuation cycles, i.e. the actuation cycles may utilize unequal numbers of pressure cycles to switch from open to closed configurations as compared to the switch from closed to open configurations. In this type of embodiment, the mini-indexer 56 may be actuated based on an odd number of pressure pulses, e.g. three pulses, five pulses, seven pulses, or other suitable number of pulses. If, for example, the mini-indexer 56 is actuated based on three pulses, the corresponding valve 128 may remain open during two pressure pulses and stay closed for one pressure pulse.

In this type of embodiment, each pressure pulse in an open direction can be used to ultimately move the actuator piston 32 to the next incremental choke position while a quick close can be achieved using a single pressure pulse supplied to the mini-indexer 56 over a sufficient duration. Accordingly, various types of mini-indexers 56 and corresponding valves 128 may be used in cooperation with metering module assembly 134 to achieve desired metering and control over the operation of hydraulically actuated device 26 while maintaining the ability for a rapid hydraulic override. The mini-indexer 56, valve 128, and metering module assembly 134 can be used to substantially reduce the number pressure cycles that would otherwise be used for controlled actuation of the flow control valve or other hydraulically actuated device 26.

Depending on parameters of a given application, the control module 28 may be constructed in a variety of configurations and may comprise various features. Examples of such features include various types of indexers, multi-position valves, pilot operated valves, metering valves, and hydraulic circuitry arrangements. Depending on the parameters of a given operation, the control module 28 may be coupled with a single hydraulic control line 30 or a plurality of hydraulic control lines 30, e.g. two hydraulic control lines.

Similarly, the control module 28 may be used to control actuation of many types of devices. In a variety of well operations, e.g. production operations, the control module 28 may be used to control a corresponding flow control valve used to control fluid flow with respect to a downhole completion, e.g. to control the inflow of well fluids into sand screen assemblies. Some applications utilize multiple control models 28 with multiple corresponding flow control valves or other hydraulically controlled devices. The control module 28 also may be used in non-well related applications to similarly control a specific hydraulically controlled device or devices.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string deployed in a wellbore, the well string comprising a flow control valve and a control module for controlling flow positions of the flow control valve via positioning of an actuator piston in the flow control valve, the system comprising a first chamber on one side of the actuator piston and a second chamber on an opposite side of the actuator piston, the control module comprising:

a hydraulic circuit arranged to enable incremental movement of the actuator piston away from a default position, the hydraulic circuit further enabling rapid, continuous return of the actuator piston to the default position, the hydraulic circuit having:

a metering system to provide the incremental movement based on changing pressure levels applied to the hydraulic circuit, the metering system comprising a metering valve having an internal metering piston and a defined volume, wherein the metering piston is biased to an original position in which the defined volume is configured to be filled with hydraulic actuating fluid, wherein the metering piston is moved from the original position to discharge the hydraulic actuating fluid from the defined volume, the defined volume correlated to an incremental shifting of the actuator piston when the metering piston is moved to discharge hydraulic actuating fluid from the defined volume, and wherein the metering piston is configured to repeatedly cycle within the valve to discharge hydraulic actuating fluid from the defined volume with each cycle; and a hydraulic override arrangement to provide the rapid, continuous return of the actuator piston to the default position, the hydraulic override arrangement comprising an override valve comprising a flow position and an override position, wherein when the override valve is in the override position, hydraulic actuating fluid flows from the first chamber through the metering valve and the override valve to the second chamber.

2. The system as recited in claim 1, further comprising a single hydraulic control line coupled to the control module to supply the hydraulic circuit with hydraulic actuating fluid.

3. The system as recited in claim 1, further comprising a pair of hydraulic control lines coupled to the control module to supply the hydraulic circuit with hydraulic actuating fluid.

4. The system as recited in claim 1, wherein the hydraulic circuit comprises a mini-indexer positioned to receive an inflow of hydraulic actuating fluid from a hydraulic control line, the mini-indexer being shiftable between flow positions based on pulses received through the hydraulic control line.

5. The system as recited in claim 1, wherein the override valve is biased to the override position which allows mechanical movement of the actuator piston without hydraulic lock up.

6. The system as recited in claim 1, wherein the metering system comprises a metering piston assembly having a metering piston coupled with a collet.

7. The system as recited in claim 1, wherein the metering system comprises a metering valve working in cooperation with a pair of pilot operated valves.

8. The system as recited in claim 1, wherein the hydraulic override system comprises a plurality of valves biased to positions enabling venting of hydraulic actuating fluid as the actuator piston is forced to the default position.

9. A system, comprising:

a hydraulically controlled device shiftable to different operational positions via movement of a hydraulic actuator piston; and a control module hydraulically coupled with the hydraulic actuator piston and also with a hydraulic control line supplying hydraulic actuating fluid at desired pressure levels, the control module comprising:

a metering system to meter delivery of hydraulic actuating fluid to the hydraulic actuator piston to cause controlled shifting of the hydraulic actuator piston to a plurality of incremental positions, the metering system comprising a metering valve having an internal metering piston and a defined volume, wherein the metering piston is configured to be moved to an original position in which the defined volume is configured to be filled with hydraulic actuating fluid, wherein the metering piston is configured to be moved from the original position to discharge the hydraulic actuating fluid from the defined volume, the defined volume correlated to the controlled shifting of the actuator piston to the plurality of incremental positions when the metering piston is moved to discharge hydraulic actuating fluid from the defined volume, and wherein the metering piston is configured to repeatedly cycle within the valve to discharge hydraulic actuating fluid from the defined volume with each cycle; and a plurality of valves providing a hydraulic override arrangement enabling selective transition of the hydraulic actuator piston back to an original position without hydraulic lock.

10. The system as recited in claim 9, wherein the metering system and the hydraulic override arrangement are part of a hydraulic circuit, the flow of hydraulic actuating fluid into the hydraulic circuit from the hydraulic control line being controlled by an indexer.

11. The system as recited in claim 9, wherein the hydraulic control line comprises a pair of hydraulic control lines.

12. The system as recited in claim 9, wherein the hydraulically controlled device comprises a flow control valve.

13. The system as recited in claim 12, wherein the flow control valve is located in a well string deployed in a wellbore.

14. The system as recited in claim 9, wherein the metering piston is a spring-loaded metering piston.

15. The system as recited in claim 9, wherein the metering system comprises a metering piston assembly with a metering piston coupled to a collet.

16. The system as recited in claim 9, wherein the metering system comprises a metering valve operationally coupled with a pair of pilot operated valves.

17. A method, comprising:

positioning a hydraulically actuated device in a wellbore;

changing operational positions of the hydraulically actuated device via an actuator piston, a first chamber being disposed on a first side of the actuator piston and a second chamber being disposed on an opposite side of the actuator piston;

fluidly coupling the actuator piston with a hydraulic circuit located downhole in the wellbore;

using the hydraulic circuit to meter predetermined amounts of actuating fluid to move the actuator piston in desired increments;

preventing hydraulic lock of the hydraulic circuit by moving an override valve to an override position to allow for mechanical movement of the actuator piston, wherein when the override valve is in the override position, actuating fluid flows from the first chamber through the override valve to the second chamber;

biasing the override valve to the override position; and controlling the hydraulic circuit via changing pressure levels delivered downhole to the hydraulic circuit via a hydraulic control line.

18. The method as recited in claim 17, wherein positioning comprises positioning a flow control valve in the wellbore.

19. The method as recited in claim 17, wherein controlling comprises controlling the hydraulic circuit to enable mechanical intervention by which the actuator piston is mechanically moved to a desired position.

* * * * *